US005803059A

United States Patent [19]

Jacobs et al.

[11] Patent Number: 5,803,059

[45] Date of Patent: Sep. 8, 1998

[54] AUTOMOTIVE INTERMEDIATE IGNITION SIGNAL CONVERTER

[75] Inventors: Christopher A. Jacobs; Gregory V. Puscas, both of Midland, Tex.

[73] Assignee: Jacobs Electronics, Inc., Midland, Tex.

[21] Appl. No.: 880,894

[22] Filed: Jun. 23, 1997

[51] Int. Cl.[6] ..... F02P 29/04

[52] U.S. Cl. ..... 123/595

[58] Field of Search ..... 123/595, 618, 123/643, 640, 594, 620, 651, 601

[56] References Cited

U.S. PATENT DOCUMENTS

| | | | |
|---|---|---|---|
| 4,058,103 | 11/1977 | Brocker | 123/595 |
| 4,269,160 | 5/1981 | Irvin, Jr. | 123/620 |
| 4,641,627 | 2/1987 | Nash | 123/651 |
| 5,423,305 | 6/1995 | Shih | 123/595 |

*Primary Examiner*—Raymond A. Nelli
*Attorney, Agent, or Firm*—Wendy Buskop; Chamberlain, Hrdlicka et al.

[57] ABSTRACT

An ignition synchronization system and method of using the same are provided for the ignition systems of internal combustion engines. The system retains all of the parts of the vehicle's original ignition system. The system adds a new ignition device having a new spark energy generating coil. In addition, a spark energy signal converter is also provided. The spark energy signal converter and the new ignition device are connected in series, respectively, between the original coil and the vehicle's original elements for distributing the spark energy. The firing signal from the vehicle's electrical system triggers the original coil to generate a spark energy pulse. The spark energy signal converter absorbs the spark energy from the original coil and generates a signal indicating that the original coil pulsed. The converter, in turn, sends a firing signal to the new ignition system, which generates spark energy for the spark plug. The disclosed invention allows the use of any aftermarket ignition devices with any vehicle electrical system without the need to rewire the vehicles's electrical connections. Nor does the use of the disclosed invention affect any of the vehicle's subsystems that rely upon signals from the original ignition system.

41 Claims, 5 Drawing Sheets

AUTOMOTIVE INTERMEDIATE IGNITION SIGNAL CONVERTER

FIELD OF THE INVENTION

The present invention relates to ignition systems. More particularly, the present invention relates to a device that synchronizes an automotive aftermarket ignition system with a vehicle's original ignition system in order to enhance internal combustion engine performance and fuel economy.

BACKGROUND OF THE INVENTION

Single and multi-cylinder internal combustion engines have been the primary power sources for machines such as vehicles for most of this century. As shown in FIG. 1, the typical automobile engine 20 has from four to eight cylinders and operates on the well known Otto thermodynamic cycle. Each cylinder is "fired" in a predetermined sequence in order to overcome internal friction, to provide energy for intake and exhaust operations of the other cylinders, and to provide power to the vehicles transmission through a crankshaft 24. The actual "firing" of the cylinder is accomplished with a spark generated between the electrode gaps of a spark plug 22 that is inserted into the cylinder of the engine. The energy, called the spark energy, for the spark plug is provided by an ignition coil 26 that is connected, typically, by a wiring harness 28, to the vehicles electrical system (not shown) that generates the firing signals. Upon receiving a "fire" signal from the vehicle's electrical system, the coil 26 generates a pulse of energy (called "spark energy") that is sufficient to generate a spark across the spark plug electrodes. Before 1990, the most typical method of routing the spark energy to the individual spark plugs was with a distributor 30 which is connected to the ignition coil 26 by means of a coil wire 32. Typically, distributors are cylindrical devices with an arm that rotates as a function of engine rotation rate (rpm). During one full rotation of the distributor, the arm will connect to "points" or terminals within the distributor, completing the electrical circuit between the spark plug 22 and the ignition coil 26 thereby releasing the spark energy to the spark plug 22 which generates the spark that fires the cylinder. The firing signal of the vehicle's electrical system is synchronized with the distributor 30. Engine performance and fuel economy can be affected adversely if the firing signals are not synchronized with the crankshaft 24. All of the aforementioned is well known in the art.

After 1990, vehicles were redesigned with one coil for each cylinder or one coil for two cylinders and no distributor. The principle remains the same regardless of the combination and there is no need for a distributor since each coil fires its own cylinder or set of two cylinders. The term "coil" in this context means the coil included with the vehicle's original ignition system for firing the spark plug.

In order to lower costs, automobile manufacturers sometimes modify the design of the ignition coil 26. While the modification may reduce cost, the modification can decrease engine performance and fuel economy by adversely affecting the spark timing or degrading the spark quality. In an effort to enhance fuel economy and engine performance, customers refit their vehicles with aftermarket (or retrofit) ignition systems. The typical aftermarket ignition system replaces the original vehicle ignition coil 26. As shown in FIG. 2, the aftermarket ignition 40 is connected to the vehicle's wiring harness 28. The aftermarket ignition 40 is also connected to an aftermarket coil 42, which in turn is connected to the distributor 30 as shown in FIG. 2.

The aftermarket ignition system must maintain (or enhance) the synchronization between the firing signals from the vehicle's electrical system and the crankshaft 24. Often, the connection between the wiring harness 28 and the aftermarket ignition 40 is made with a series of wires 44 as shown in FIG. 2. Up until the mid-1980's, the vast majority of automobiles had wires running from the vehicle's electrical system to two terminals on the original coil 26. Today, vehicles can have six or more wires embedded in the wiring harness connector 28. Furthermore, there are now subsystems, such as the tachometer, fuel injection, and emission control systems, connected to the vehicle electrical system which take their cues from the operation of the original coil 26.

Ensuring that the wires are re-connected properly to an aftermarket product can be the most difficult installation hurdle for the customer, who may be confronted with a wiring harness of a proprietary design and an aftermarket ignition that is "generalized" for use in a wide variety of vehicles. If the proper electrical connections cannot be made, or the operation of the original coil is modified as a result of the addition of an aftermarket product, such as an ignition, the engine may not be able to be started or operate in the correct manner. Worse, a wrongly connected aftermarket ignition system or a modified original coil operation may damage the engine or other vehicle subsystems.

There is, therefore, a need in the art for a means for synchronizing the operation of an aftermarket product, such as an ignition system, that enhances internal combustion engine performance and fuel economy. There is also a need in the art for a means for synchronizing the operation of an aftermarket ignition system that can be used on any vehicle. It is the purpose of the present invention to solve the synchronization problems inherent in the prior art and provide a means for triggering an aftermarket (retrofit) ignition system in a synchronized manner with the original ignition system.

SUMMARY OF THE INVENTION

The present invention solves the problems inherent in the prior art methods. The present invention is an ignition synchronization system that acts as an intermediary between the vehicle's original ignition system and an aftermarket ignition system. The present invention retains all of the parts of the vehicle's original ignition system. The present invention can be used by any aftermarket ignition system having a new spark energy generating coil. The ignition synchronization system of the present invention contains a spark energy signal converter. The present invention and the aftermarket ignition device are connected in series, respectively, between the original coil and the vehicle's original ignition system. The firing signal from the vehicle's electrical system triggers the original coil to generate a spark energy pulse. The spark energy pulse is received by the signal converter of the present invention. The signal converter absorbs the spark energy from the original coil and generates a signal indicating that the original coil pulsed. The present invention, in turn, sends a firing signal to the aftermarket ignition system, which generates spark energy for the spark plug. The present invention allows the use of any aftermarket ignition devices with any vehicle electrical system without the need to rewire the vehicles's electrical connections. In addition, the use of the present invention does not affect any of the vehicle's subsystems that rely upon signals from the original ignition system.

DETAILED DESCRIPTION OF THE INVENTION

Figure 1:
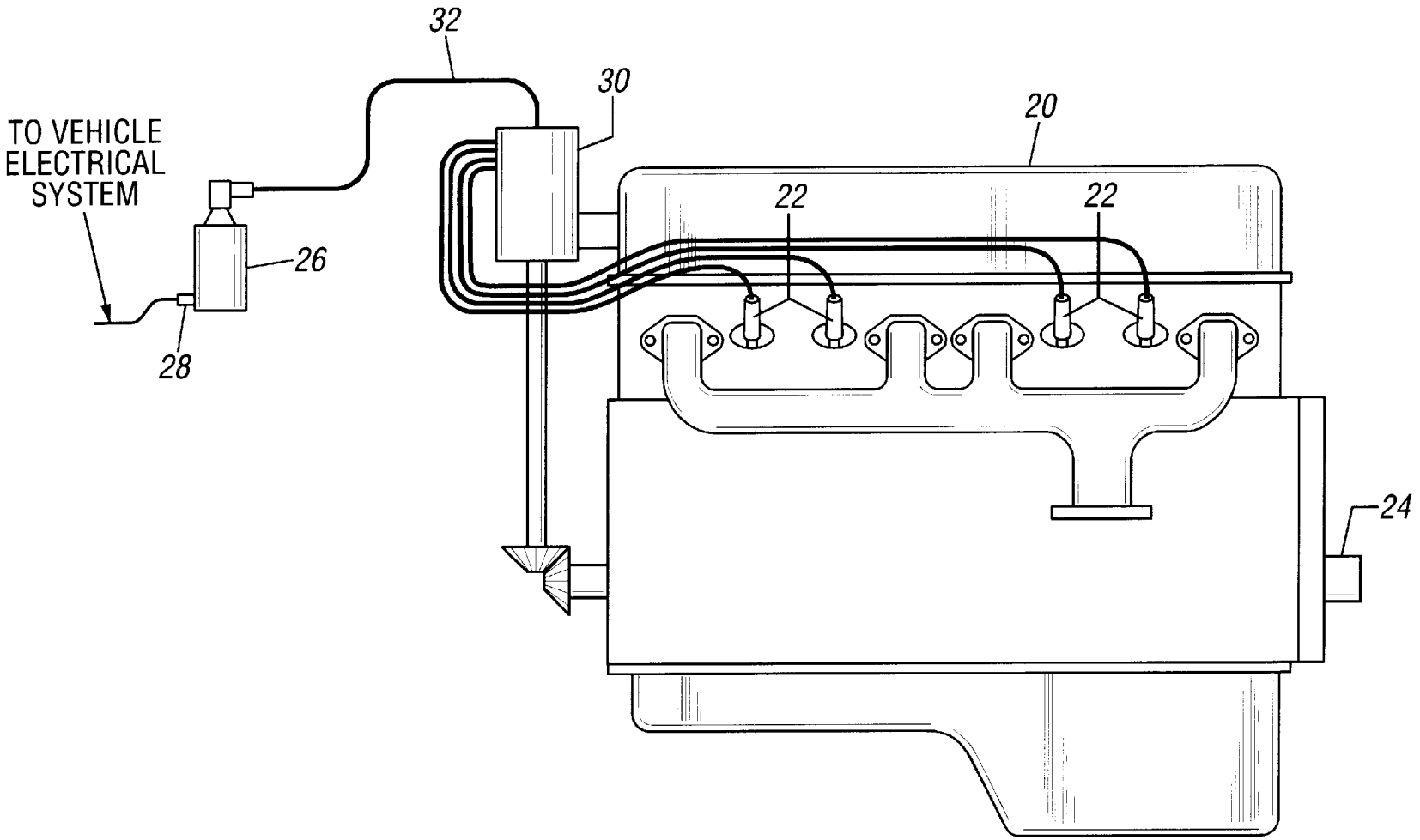
FIG. 1 shows a prior art original-equipment automotive ignition system.
Figure 2:
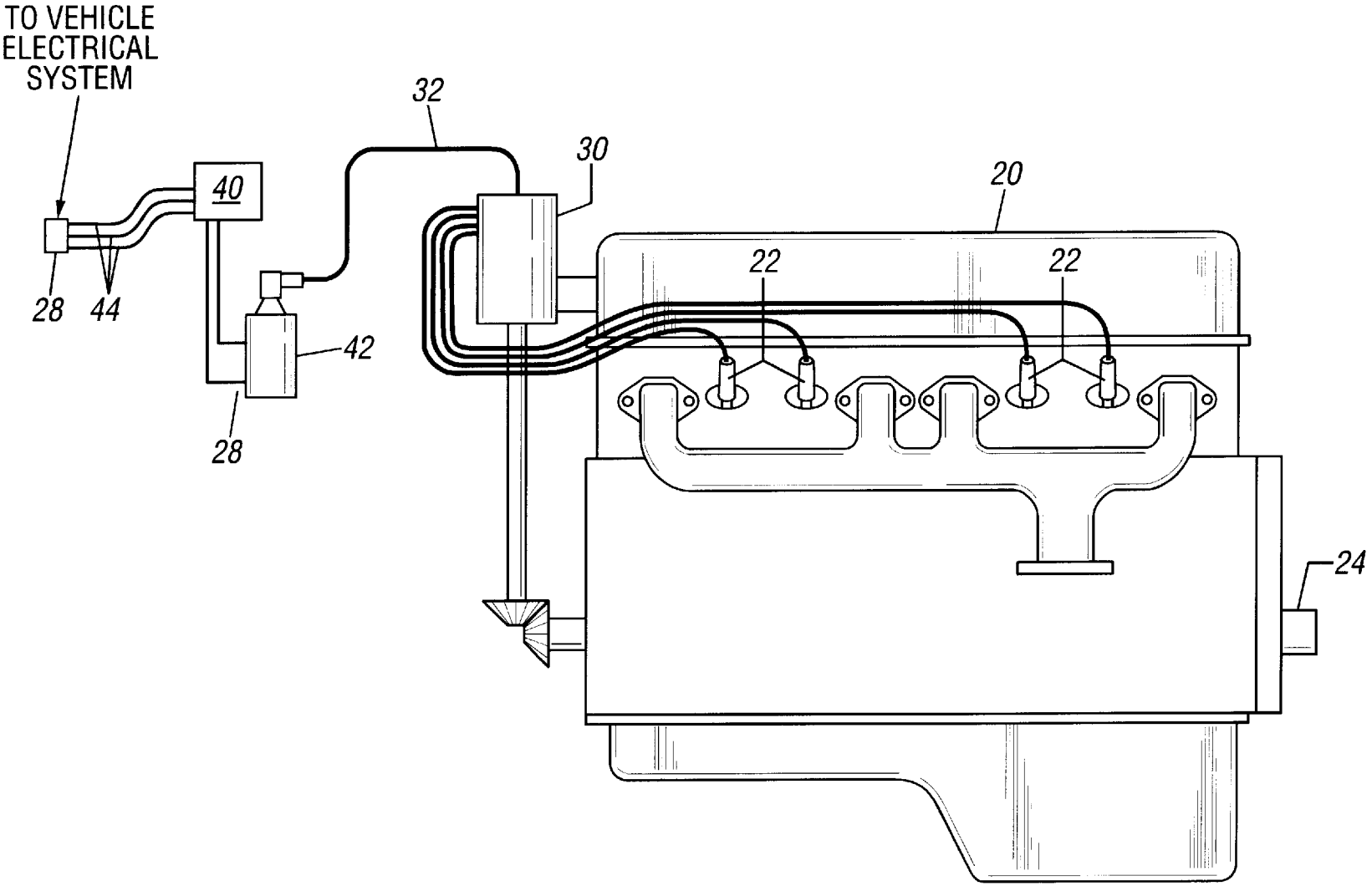
FIG. 2 shows a prior art aftermarket automotive ignition system.
Figure 3:
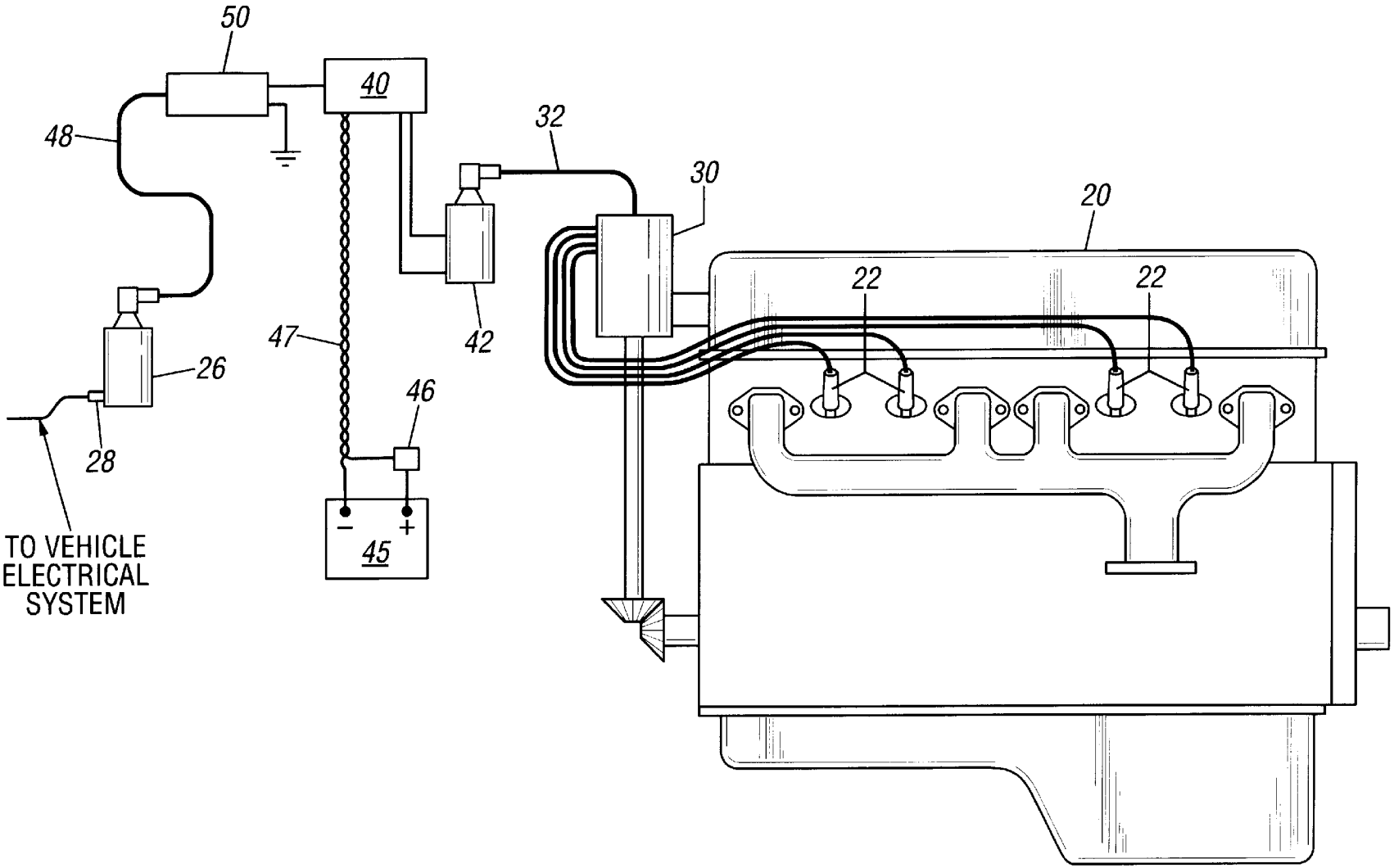
FIG. 3 shows the signal conversion means between an aftermarket automotive ignition system and the original coil of the present invention.
Figure 4:
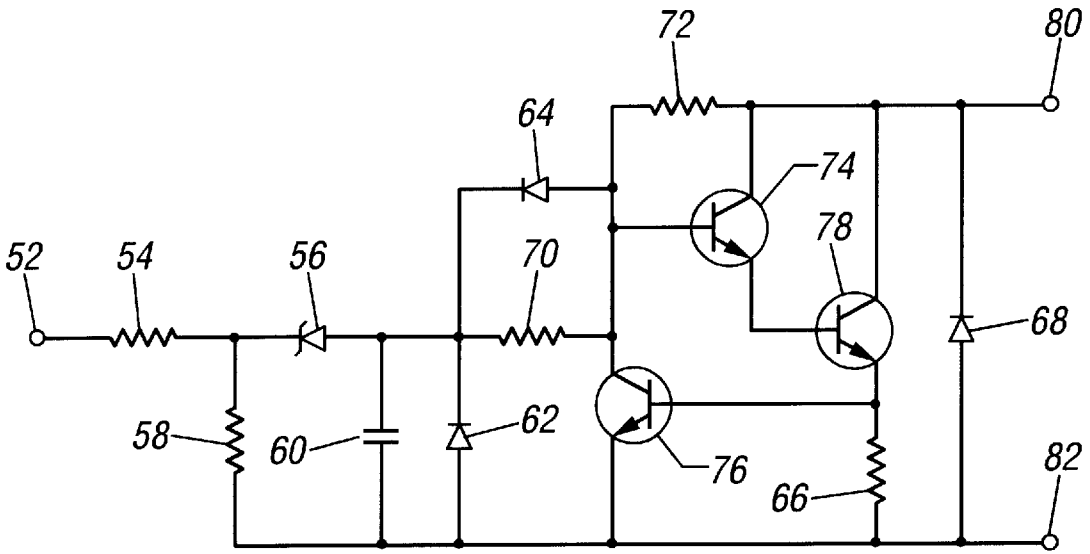
FIG. 4 shows an electrical schematic of the intermediate signal converter of the present invention.

The ignition synchronization system of the present invention leaves uninterrupted all of the parts of the original ignition system as shown in FIG. 1. It is important to point out that the function and operation of the original coil 26, which is connected to the vehicle's original equipment electrical system via wiring harness 28 is retained. As shown in FIG. 3, the present invention also retains the original means of high voltage distribution (e.g., the distributor 30) to the spark plugs 22 on the engine 20. The ignition synchronization system of the present invention connect utilizes an aftermarket ignition 40 that has an aftermarket coil 42 that is synchronized (i.e., contemporaneous) with the original ignition system by the intermediate signal converter 50 that is contained within the present invention. As with prior art aftermarket ignition systems, the aftermarket coil 42 is connected to the vehicle's high voltage distribution means via coil wire 32 as shown in FIG. 4. As shown in FIG. 3, the aftermarket ignition system 40 is electrically connected to the vehicle battery 45 by a twisted wire pair 47 (one wire each for the positive terminal and the negative terminal of the battery 45). The positive wire of the twisted wire pair 47 contains a fuse 46, typically positioned near the positive terminal connection of the battery 45. Because operation of the original coil 26 remains unaffected, it still generates signal voltages and current in the original manner such that the subsystems that take as their input waveforms echoed from the original ignition system (e.g., tachometer, fuel injection, emissions, etc.) operate unaffected.

The intermediate signal converter 50 of the present invention absorbs the energy generated by the original coil 26 and converts the energy into a non detrimental firing signal for the aftermarket ignition 40. As shown in FIG. 3, the intermediate signal converter 50 lies, in series, between the original coil 26 and the aftermarket ignition 40. In this manner, the firing signal, which originated from the vehicle's original ignition system, is provided to the aftermarket ignition 40 without damaging or modifying the wiring harness 28.

As shown in the electrical schematic of FIG. 4, the preferred embodiment of the present invention is the intermediate signal converter 50 that comprises a variety of electrical components. Connection point 52 is connected to the output of the original coil 26. A standard coil wire 48 (as shown in FIG. 3) will be able to accommodate the spark energy pulse from the coil 26. From connection point 52, the spark energy pulse, which is in the form of a high-voltage signal of negative polarity, first goes through resistor 54. In the preferred embodiment of the invention, resistor 54 is rated at 40,000 Ω and 10 Watts. The resistor 54 absorbs the spark energy from the original coil 26. The energy absorbed by the resistor 54 can be dissipated (transferred) to a standard heat transfer casing (not shown) that transfers the heat generated to other vehicle parts or the atmosphere. Alternate embodiments of the present invention can utilize a capacitor, an inductor, a transistor, a zener diode, a silicon control rectifier (SCR), or a control leakage diode in lieu of resistor 54.

The resistor 54 and resistor 58 form a resistor divider. Zener diode 56 acts as a low-voltage filter by cutting off low voltage signals. Another benefit of using Zener diode 56 is that it allows for some hysteresis in the signal which provides better overall performance of the signal converter 50. Resistor 54 and capacitor 60 form a low pass filter that eliminates high frequency noise that can be captured by the distributor wire 48. In the preferred embodiment of the present invention, the resistor 58 is rated at 1,000 Ω and the capacitor 60 is rated at 220 pF.

Diode 62 of FIG. 4 "clamps" the resultant negative voltage signal to less than one volt. The clamped negative voltage signal is then routed through forward biased diode 64 to a common emitter current amplifier which is comprised of two high current gain transistors 74 and 78. The clamped negative signal turns the transistors 74 and 78 "off" and inverts the signal 180° into a positive signal which is transmitted to the aftermarket ignition 40 via the output connection point 80 for the requisite time period needed to signal the aftermarket ignition 40 that a spark is required immediately. After the signal to the input of the current amplifier drops to a sufficiently low level, resistors 70 and 72 are used to turn the current amplifier "on" and ensure that it stays on until the next signal from the original coil 26. Connection point 82 is connected, in the preferred embodiment, to the ground of the aftermarket ignition system 40. However, in an alternate embodiment of the present invention, the connection point 82 is connected to the vehicle ground. In the preferred embodiment of the present invention, the resistor 70 is rated at 2,200 Ω and resistor 72 is rated at 1,000 Ω . Transistor 76, resistor 66, and diode 68 form a circuit protection system in case the output connection point 80 and the ground connection point 82 are mis-connected. In the preferred embodiment, the resistor 66 is rated at 2 Ω. After the electronics board is constructed, it is encased in a heat-sink casing with the connecting wires to connection points 52, 80, and 82 accessible for connection to the original coil 26, the aftermarket ignition 40, and the vehicle ground, respectively. The heat-sink casing is most commonly made of metal, with a plurality of flanges along the periphery of the heat-sink casing in order to facilitate the transfer of heat from the resistor 54 to the atmosphere.

The preferred embodiment of the present invention takes, as its input, a negative polarity high voltage signal from the original coil and converts it into a positive polarity low voltage signal for the aftermarket ignition system. This configuration is utilized about 99% of the time. However, in some rare instances, a positive polarity high voltage signal is issued from the original coil. Retrofit ignition systems, anticipating a typical positive polarity low voltage signal, requires that the positive polarity high voltage signal be converted to a low voltage positive polarity signal in the same manner as the preferred embodiment of the present invention.

Figure 5:
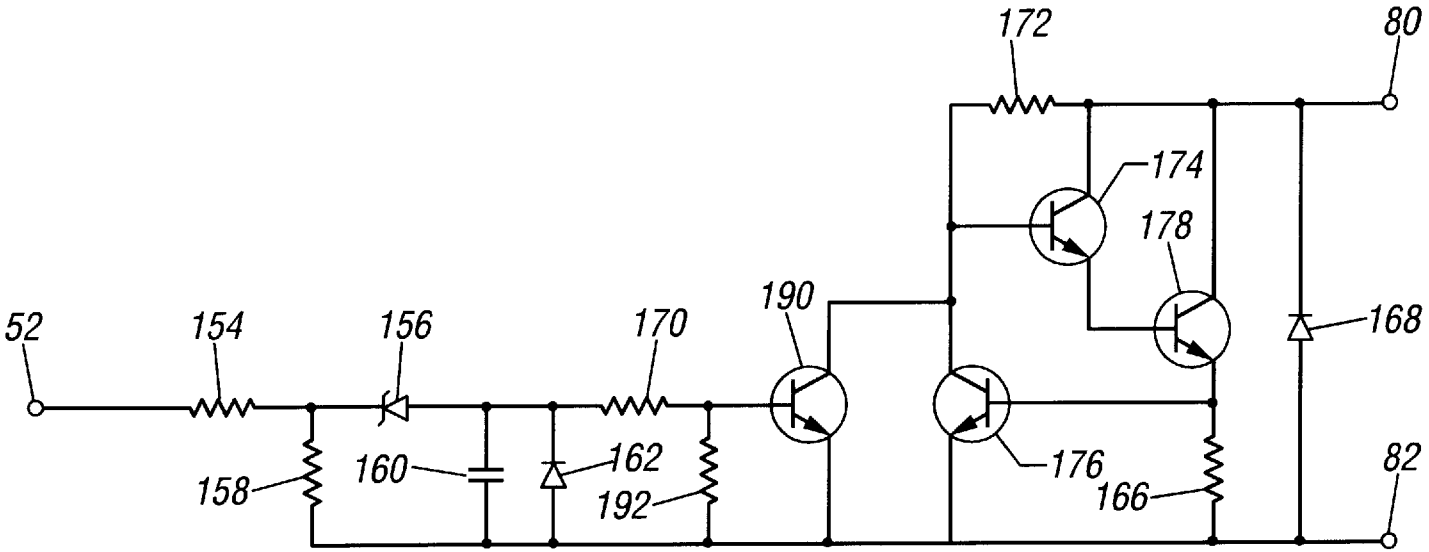
FIG. 5 shows an alternate embodiment of the present invention.

An alternate embodiment of the invention is shown in the electrical schematic of FIG. 5. In this embodiment, connection point 52 is connected to the output of the original coil 26. A standard coil wire 48 (as shown in FIG. 3) will be able to accommodate the spark energy pulse from the coil 26. From connection point 52, the spark energy pulse, which is in the form of a high-voltage signal of positive polarity, first goes through resistor 154. In the alternate embodiment, resistor 154 is rated at 40,000 Ω and 10 Watts. The resistor 154 absorbs the spark energy from the original coil 26. The energy absorbed by the resistor 154 can be dissipated (transferred) to a standard heat transfer casing (not shown) that transfers the heat generated to other vehicle parts or the atmosphere. As with the preferred embodiment, the alternate embodiment of the present invention can utilize a capacitor, an inductor, a transistor, a zener diode, a silicon control rectifier (SCR), or a control leakage diode in lieu of resistor 154.

The resistor 154 and resistor 158 form a resistor divider. Because of the reversed polarity, zener diode 156 is in the reverse direction. Resistor 154 and capacitor 160 form a low pass filter that eliminates high frequency noise that can be captured by the distributor wire 48. In the alternate embodiment of the present invention, the resistor 158 is rated at 1,000 Ω and the capacitor 160 is rated at 220 pF.

The purpose of the alternate embodiment is to transform a high voltage low current pulse positive polarity signal from the original coil 26 into a low voltage high current signal that is sent to the retrofit ignition system. In contrast to the three transistors of the preferred embodiment, there are four transistors 174, 178, 190, 176 in the alternate embodiment. The transistor pair 174-178 form a high gain common emitter current amplifier, and as in the preferred embodiment, inverts the signal 180°. The additional transistor 190 inverts the signal 180°. As the signal is inverted twice, the output signal has the same polarity as the input signal but is emitted as a low voltage high current signal required by the retrofit ignition system 40. Aside from the double inversion of the polarity, and the handling of the initial positive polarity signal as previously described, the circuitry of the alternate embodiment functions similarly to the circuitry of the preferred embodiment.

The forgoing is a description of the arrangement and the operation of an embodiment of the invention. The scope of the invention is considered to include the described embodiment together with others obvious to those skilled in the art.

What is claimed is:

1. An ignition synchronization device for an internal combustion engine, said engine having at least one cylinder with a spark plug, said engine further having an original ignition system that provides a first firing signal, said original ignition system further having a coil that provides a first spark energy upon receiving said first firing signal, said engine further having a retrofit ignition system, said retrofit ignition system being electrically connected to said spark plug, said retrofit ignition system constructed and arranged to provide a second spark energy to said spark plug upon receiving a second firing signal, said device comprising:

an intermediate spark energy signal converter, said converter being electrically connected to said coil and to said retrofit ignition system, said converter having means for absorbing said first spark energy from said coil, said converter constructed and arranged to provide said retrofit ignition system with said second firing signal that causes said retrofit ignition system to generate said second spark energy thereby causing said spark plug to fire said cylinder.

2. An ignition synchronization device as in claim 1 wherein said second firing signal is synchronized with said first firing signal.

3. An ignition synchronization device as in claim 1 wherein said means for absorbing said first spark energy from said coil is a resistor.

4. An ignition synchronization device as in claim 1 wherein said means for absorbing said first spark energy from said coil is a capacitor.

5. An ignition synchronization device as in claim 1 wherein said means for absorbing said first spark energy from said coil is a inductor.

6. An ignition synchronization device as in claim 1 wherein said means for absorbing said first spark energy from said coil is a transistor.

7. An ignition synchronization device as in claim 1 wherein said means for absorbing said first spark energy from said coil is a zener diode.

8. An ignition synchronization device as in claim 1 wherein said means for absorbing said first spark energy from said coil is a silicon control rectifier.

9. An ignition synchronization device as in claim 1 wherein said means for absorbing said first spark energy from said coil is a control leakage diode.

10. An ignition synchronization device as in claim 1 wherein, said first spark energy from said coil is in the form of a high voltage signal, and said converter converts said high voltage signal from said coil into said second firing contemporaneously upon receiving said first spark energy.

11. An ignition synchronization device as in claim 10 wherein said high voltage signal is of negative polarity.

12. An ignition synchronization device as in claim 11 wherein said converter contains a current amplifier for converting said negative polarity signal into a positive polarity signal.

13. An ignition synchronization device as in claim 10 wherein said high voltage signal is of positive polarity.

14. An ignition synchronization device as in claim 13 wherein said converter contains a current amplifier for converting said positive polarity high voltage signal into a low voltage positive polarity signal.

15. A method for synchronizing an original ignition system for an internal combustion engine with a retrofit ignition system, said engine having at least one spark plug in a cylinder, said original ignition system having a coil that generates a first spark energy upon receiving a first firing signal, said retrofit ignition system constructed and arranged to provide a second spark energy upon receipt of a second firing signal, said system comprising the steps of:

providing an intermediate spark energy signal converter, said converter having means for absorbing said first spark energy from said coil, said converter constructed and arranged to provide said retrofit ignition with said second firing signal;

electrically connecting said converter to said coil; and electrically connecting said converter to said retrofit ignition system so that, when said coil generates said first spark energy, said converter absorbs said first spark energy and generates said second signal to said retrofit ignition system prompting said retrofit ignition system to generate a second spark energy that is transmitted to said spark plug in said cylinder in order to fire said cylinder.

16. A method for synchronizing two ignition systems as in claim 15 wherein said second firing signal is synchronized with said first firing signal.

17. A method for synchronizing two ignition systems as in claim 15 wherein said means for absorbing said first spark energy from said coil is a resistor.

18. A method for synchronizing two ignition systems as in claim 15 wherein said means for absorbing said first spark energy from said coil is a capacitor.

19. A method for synchronizing two ignition systems as in claim 15 wherein said means for absorbing said first spark energy from said coil is a inductor.

20. A method for synchronizing two ignition systems as in claim 15 wherein said means for absorbing said first spark energy from said coil is a transistor.

21. A method for synchronizing two ignition systems as in claim 15 wherein said means for absorbing said first spark energy from said coil is a zener diode.

22. A method for synchronizing two ignition systems as in claim 15 wherein said means for absorbing said first spark energy from said coil is a silicon control rectifier.

23. A method for synchronizing two ignition systems as in claim 15 wherein said means for absorbing said first spark energy from said coil is a control leakage diode.

24. A method for converting a spark energy pulse to a signal comprising the steps of providing a negative polarity spark energy pulse from a coil;

absorbing said negative polarity spark energy pulse with absorber means for absorbing said spark energy pulse in order to provide a low voltage negative polarity signal;

providing a current amplifier in the form of a high current gain transistor pair;

directing said low voltage negative polarity signal through said current amplifier in order to invert said negative polarity signal into a positive polarity signal.

25. A method as in claim 24 wherein said absorber means comprises a resistor.

26. A method as in claim 24 wherein said absorber means comprises a capacitor.

27. A method as in claim 24 wherein said absorber means comprises an inductor.

28. A method as in claim 24 wherein said absorber means comprises a transistor.

29. A method as in claim 24 wherein said absorber means comprises a zener diode.

30. A method as in claim 24 wherein said absorber means comprises a silicon control rectifier.

31. A method as in claim 24 wherein said absorber means comprises a control leakage diode.

32. A method for converting a spark energy pulse as in claim 24, wherein said spark energy from said coil is transferred from said absorber means to a heat-transfer casing.

33. A method for converting a spark energy pulse to a signal comprising the steps of:

providing a positive polarity spark energy pulse from a coil;

absorbing said positive polarity spark energy pulse with absorber means for absorbing said spark energy pulse in order to provide a low energy positive polarity signal;

providing two current amplifiers;

directing said low energy positive polarity signal through both of said current amplifiers in order to transform said high voltage signal into a low voltage positive polarity signal.

34. A method for converting a spark energy pulse as in claim 33, wherein said spark energy from said coil is transferred from said absorber means to a heat-transfer casing.

35. A method as in claim 33 wherein said absorber means comprises a resistor.

36. A method as in claim 33 wherein said absorber means comprises a capacitor.

37. A method as in claim 33 wherein said absorber means comprises an inductor.

38. A method as in claim 33 wherein said absorber means comprises a transistor.

39. A method as in claim 33 wherein said absorber means comprises a zener diode .

40. A method as in claim 33 wherein said absorber means comprises a silicon control rectifier.

41. A method as in claim 33 wherein said absorber means comprises a control leakage diode.

* * * * *